US008459052B2

(12) United States Patent
Bush et al.

(10) Patent No.: US 8,459,052 B2
(45) **Date of Patent: *Jun. 11, 2013**

(54) REFRIGERANT VAPOR COMPRESSION SYSTEM WITH FLASH TANK RECEIVER

(75) Inventors: James W. Bush, Skaneateles, NY (US); Wayne P. Beagle, Chittenango, NY (US); Biswajit Mitra, Charlotte, NC (US)

(73) Assignee: Carrier Corporation, Farmington, CT (US)

( * ) Notice: Subject to any disclaimer, the term of this patent is extended or adjusted under 35 U.S.C. 154(b) by 213 days.

This patent is subject to a terminal disclaimer.

(21) Appl. No.: 13/005,228

(22) Filed: Jan. 12, 2011

(65) Prior Publication Data

US 2011/0100040 A1 May 5, 2011

Related U.S. Application Data

(63) Continuation of application No. 11/886,828, filed as application No. PCT/US2006/038438 on Sep. 29, 2006, now Pat. No. 7,891,201.

(51) Int. Cl.
*F25B 41/04* (2006.01)

(52) U.S. Cl.
USPC ..... 62/222; 62/430

(58) Field of Classification Search
USPC ..... 62/115, 228.3, 228.5, 509, 510, 149, 62/430, 222, 218
See application file for complete search history.

(56) References Cited

U.S. PATENT DOCUMENTS

| | | | | |
|---|---|---|---|---|
| 4,475,360 | A | 10/1984 | Suefuji et al. | |
| 4,926,653 | A | 5/1990 | Masuda et al. | |
| 4,934,390 | A | 6/1990 | Sapp | |
| 5,174,123 | A | 12/1992 | Erickson | |
| 5,357,766 | A | 10/1994 | Shiraishi et al. | |
| 5,431,026 | A * | 7/1995 | Jaster | 62/221 |
| 5,692,389 | A | 12/1997 | Lord et al. | |
| 5,829,265 | A | 11/1998 | Lord et al. | |
| 6,044,655 | A | 4/2000 | Ozaki et al. | |
| 6,250,099 | B1 | 6/2001 | Furuya et al. | |
| 6,385,980 | B1 | 5/2002 | Sienel | |
| 6,941,769 | B1 * | 9/2005 | Hill et al. | 62/512 |
| 7,131,294 | B2 * | 11/2006 | Manole | 62/513 |

(Continued)

FOREIGN PATENT DOCUMENTS

| | | |
|---|---|---|
| DE | 19702097 | 7/1997 |
| JP | 1121657 | 5/1989 |

(Continued)

*Primary Examiner* — Mohammad M Ali

(74) *Attorney, Agent, or Firm* — Cantor Colburn LLP

(57) ABSTRACT

A refrigerant vapor compression system includes a flash tank receiver disposed in the refrigerant circuit intermediate the refrigerant cooling heat exchanger and the refrigerant heating heat exchanger. The flash tank receiver, which receives a liquid/vapor refrigerant mix, also functions as a receiver. A refrigerant charge control apparatus includes at least one sensor for sensing an operating characteristic of the refrigerant circulating through the refrigerant compression device, and a controller operative to selectively adjust a secondary expansion device to increase or decrease the flow of refrigerant passing into the flash tank receiver to provide a circulating refrigerant charge consistent with maintaining a desired system operating characteristic. The sensed operating characteristic is at least one of (a) the vapor refrigerant passing through a refrigerant line from the flash tank receiver to an intermediate pressure stage of the compression device, and (b) the refrigerant discharged from the compression device.

15 Claims, 4 Drawing Sheets

U.S. PATENT DOCUMENTS

| | | | | |
|---|---|---|---|---|
| 7,137,270 | B2 | 11/2006 | Lifson et al. | |
| 7,299,649 | B2 * | 11/2007 | Healy et al. | 62/324.4 |
| 7,356,998 | B2 | 4/2008 | Lee et al. | |
| 7,600,390 | B2 * | 10/2009 | Manole | 62/228.1 |
| 2006/0021362 | A1 | 2/2006 | Sadegh et al. | |
| 2006/0201930 | A1 | 9/2006 | Shindo | |

FOREIGN PATENT DOCUMENTS

| | | |
|---|---|---|
| JP | 6034206 | 2/1994 |
| JP | 7071830 | 3/1995 |
| JP | 10115470 | 5/1998 |
| JP | 11063694 | 3/1999 |
| JP | 2001004235 | 1/2001 |
| JP | 2005214444 A | 8/2005 |

* cited by examiner

REFRIGERANT VAPOR COMPRESSION SYSTEM WITH FLASH TANK RECEIVER

CROSS-REFERENCE TO RELATED APPLICATION

This application is a continuing application of U.S. patent application Ser. No. 11/886,828, filed Sep. 21, 2007, entitled "Refrigerant Vapor Compression System With Flash Tank Receiver," which application is incorporated herein in its entirety by reference.

FIELD OF THE INVENTION

This invention relates generally to refrigerant vapor compression systems and, more particularly, to simultaneous efficiency improvement and regulation of refrigerant charge in a refrigerant vapor compression system operating in either a subcritical cycle or in a transcritical cycle.

BACKGROUND OF THE INVENTION

Refrigerant vapor compression systems are well known in the art and commonly used for conditioning air to be supplied to a climate controlled comfort zone within a residence, office building, hospital, school, restaurant or other facility. Refrigerant vapor compression systems are also commonly used in transport refrigeration systems for refrigerating air supplied to a temperature controlled cargo space of a truck, trailer, container or the like for transporting perishable items. Traditionally, most of these refrigerant vapor compression systems operate at subcritical refrigerant pressures and typically include a compressor, a condenser, and an evaporator, and expansion device, commonly an expansion valve, disposed upstream, with respect to refrigerant flow, of the evaporator and downstream of the condenser. These basic refrigerant system components are interconnected by refrigerant lines in a closed refrigerant circuit, arranged in accord with known refrigerant vapor compression cycles, and operated in the subcritical pressure range for the particular refrigerant in use. Refrigerant vapor compression systems operating in the subcritical range are commonly charged with fluorocarbon refrigerants such as, but not limited to, hydrochlorofluorocarbons (HCFCs), such as R22, and more commonly hydrofluorocarbons (HFCs), such as R134a, R410A and R407C.

In today's market, greater interest is being shown in "natural" refrigerants, such as carbon dioxide, for use in air conditioning and transport refrigeration systems instead of HFC refrigerants. However, because carbon dioxide has a low critical temperature, most refrigerant vapor compression systems charged with carbon dioxide as the refrigerant are designed for operation in the transcritical pressure regime. In refrigerant vapor compression systems operating in a subcritical cycle, both the condenser and the evaporator heat exchangers operate at refrigerant temperatures and pressures below the refrigerant's critical point. However, in refrigerant vapor compression systems operating in a transcritical cycle, the heat rejection heat exchanger, which is a gas cooler rather than a condenser, operates at a refrigerant temperature and pressure in excess of the refrigerant's critical point, while the evaporator operates at a refrigerant temperature and pressure in the subcritical range.

Control of refrigerant charge in a subcritical refrigerant vapor compression system is relatively simple. Conventional subcritical refrigerant vapor compression systems may also include a receiver disposed in the refrigerant circuit downstream of the condenser and upstream of the expansion device. Liquid refrigerant from the condenser enters the receiver tank and settles to the bottom of the tank. As this liquid will be at saturated temperature, refrigerant vapor will fill the space in the tank not filled by liquid refrigerant. Liquid refrigerant is metered out of the receiver tank by the expansion valve which controls refrigerant flow to the evaporator. As the operating conditions of the subcritical refrigerant vapor compression system change, the charge requirements for the system will change and the liquid level in the receiver tank will rise or fall, as appropriate, to establish a new equilibrium liquid level.

If at any point in operation there is too much refrigerant charge circulating in the system, the rate of liquid refrigerant entering the receiver tank will exceed the rate of refrigerant leaving the receiver tank and the liquid level within the receiver tank will rise until equilibrium is reached between the rate of liquid entering the receiver tank and the rate of liquid leaving the receiver tank with the excess liquid remaining stored in the receiver tank. If an any point in operation there is too little refrigerant charge circulating in the system, the rate of liquid refrigerant entering the receiver tank will be less than the rate of liquid leaving the receiver tank and the liquid level within the receiver tank will drop as liquid returns from the receiver tank to the refrigerant circuit to circulate therethrough. The liquid level within the receiver tank will continue to drop until a new equilibrium is established between the rate of liquid entering the receiver tank and the rate of liquid leaving the receiver tank.

In a transcritical refrigerant vapor compression system, however, controlling the system refrigerant charge is more complex because the compressor high side refrigerant leaving the gas cooler is above the refrigerant's critical point and there is no distinct liquid or vapor phase and thus the charge present in the receiver becomes a function of temperature and pressure which may not respond in a desirable manner to system charge requirements. One system commonly proposed for use in connection with charge regulation on transcritical refrigerant vapor compression systems includes a flash tank disposed downstream of the gas cooler and upstream of the expansion device with respect to refrigerant flow. A flow regulating throttling valve is disposed in the refrigerant line at the entry to the flash tank. Supercritical pressure refrigerant gas passing through the flow regulating throttling valve drops in pressure to a subcritical pressure forming a subcritical pressure liquid/vapor refrigerant mixture which collects in the flash tank with the liquid refrigerant settling to the lower portion of the tank and the vapor refrigerant collecting in the portion of the flash tank above the liquid refrigerant. A float valve is provided within the flash tank and operatively connected by a mechanical linkage mechanism to control operation of the flow regulating throttling valve to maintain a predetermined liquid level within the flash tank. If the liquid level in the flash tank should raise, the float raises therewith and causes the throttle valve to close further to restrict the flow of refrigerant into the flash tank. Conversely, if the liquid level in the flash tank should drop, the float drops therewith and causes the throttle valve to open more to increase the flow of refrigerant into the flash tank. The liquid level with the flash tank is thus maintained at the predetermined liquid level which is selected to ensure that only liquid phase refrigerant returns to the refrigerant circuit from the lower region of the flash tank to pass through the expansion device upstream of the evaporator and that only vapor phase refrigerant returns to the refrigerant circuit from the upper region of the flash tank to be passed back to the compressor for recompression through an economizer line.

U.S. Pat. No. 5,174,123 discloses a subcritical refrigerant vapor compression system including a compressor, a condenser, and an evaporator, with a float-less flash tank disposed between the compressor and the evaporator. Refrigerant flows into the flash tank from the condenser at saturated conditions. The flow of refrigerant into the flash tank is controlled by selectively opening or closing a sub-cooling valve to maintain a desired degree of sub-cooling. The flow of liquid refrigerant out of the flash tank to the evaporator is controlled by a suction superheat thermostatic expansion valve. Refrigerant vapor collecting in the flash tank above the liquid refrigerant therein is returned to the compressor, being injected into an intermediate pressure stage of the compressor. Because of the float-less nature of the flash tank, the disclosed refrigerant vapor compression system is said to be particularly suited for transport refrigeration applications.

U.S. Pat. No. 6,385,980 discloses a transcritical refrigerant vapor compression system including a float-less flash tank disposed between a gas cooler and an evaporator and a controller regulating valves in response to the sensed refrigerant pressure in the gas cooler to control the amount of charge in the flash tank to regulate the refrigerant pressure in the gas cooler. The controller controls the flow of supercritical refrigerant from the gas cooler into the flash tank by regulating an in-line expansion valve on the entry side of the flash tank and the flow of liquid refrigerant from the flash tank to the evaporator by regulating an in-line expansion valve on the exit side of the flash tank. Refrigerant vapor collecting in the flash tank above the refrigerant liquid therein is returned to an intermediate pressure stage of the compression device. In an embodiment, the compression device is a pair of compressors disposed in series and the refrigerant vapor is used to cool the refrigerant vapor discharged from the first compressor before it passes into the second compressor.

SUMMARY OF THE INVENTION

In an aspect of the invention, it is an object of the invention to provide a refrigerant vapor compression system including a flash tank receiver and a controller for maintaining a circulating refrigerant charge consistent with a desired operating characteristic of the refrigerant.

In an aspect of the invention, it is an object of the invention to provide a refrigerant vapor compression system including a flash tank receiver and a controller for monitoring and controlling the level of liquid refrigerant in the flash tank receiver.

In an embodiment, a refrigerant vapor compression system includes a refrigerant compression device, a refrigerant cooling heat exchanger, a flash tank receiver and a refrigerant heating heat exchanger disposed in series flow arrangement in a refrigerant circuit. A main expansion device is disposed in the refrigerant circuit downstream of the flash tank receiver and upstream of the refrigerant heating heat exchanger and a secondary expansion device is disposed in the refrigerant circuit downstream of the refrigerant cooling heat exchanger and upstream with of the flash tank receiver. The refrigerant vapor compression system further includes a refrigerant charge control apparatus including at least one sensor operatively associated with the refrigerant circuit for sensing an operating characteristic of the refrigerant circulating through the refrigerant circuit, and a controller operatively associated with said secondary expansion device. The controller is operative in response to at least one system operating parameter sensed by the at least one sensor to selectively adjust the secondary expansion device to increase or decrease the flow of refrigerant passing therethrough to maintain a circulating refrigerant charge consistent with a desired operating characteristic of the refrigerant.

The refrigerant vapor compression system may also include an economizer refrigerant line establishing a refrigerant flow path from an upper region of the flash tank receiver to an intermediate pressure region of the compression device for passing a flow of vapor refrigerant from the flash tank receiver into the compression device.

The sensed operating characteristic of the refrigerant may be refrigerant temperature or refrigerant pressure. In an embodiment, the refrigerant vapor compression system is a transport refrigeration system for cooling air supplied to a temperature controlled cargo space.

BRIEF DESCRIPTION OF THE DRAWINGS

For a further understanding of these and other objects of the invention, reference will be made to the following detailed description of the invention which is to be read in connection with the accompanying drawing, where.

DETAILED DESCRIPTION OF THE INVENTION

Figure 1:
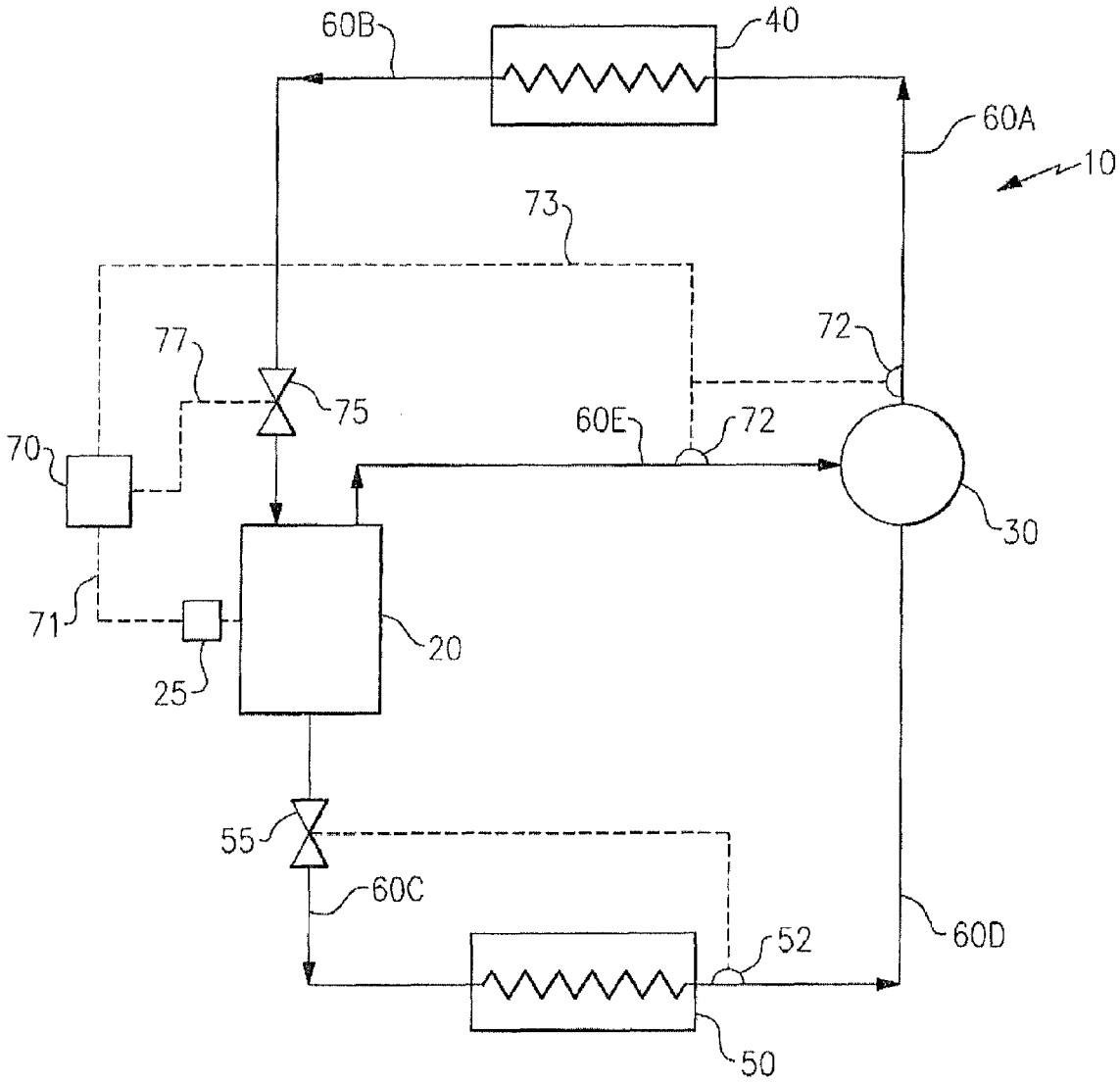
FIG. 1 is a schematic diagram illustrating a first exemplary embodiment of a refrigerant vapor compression system in accord with the invention.
Figure 2:
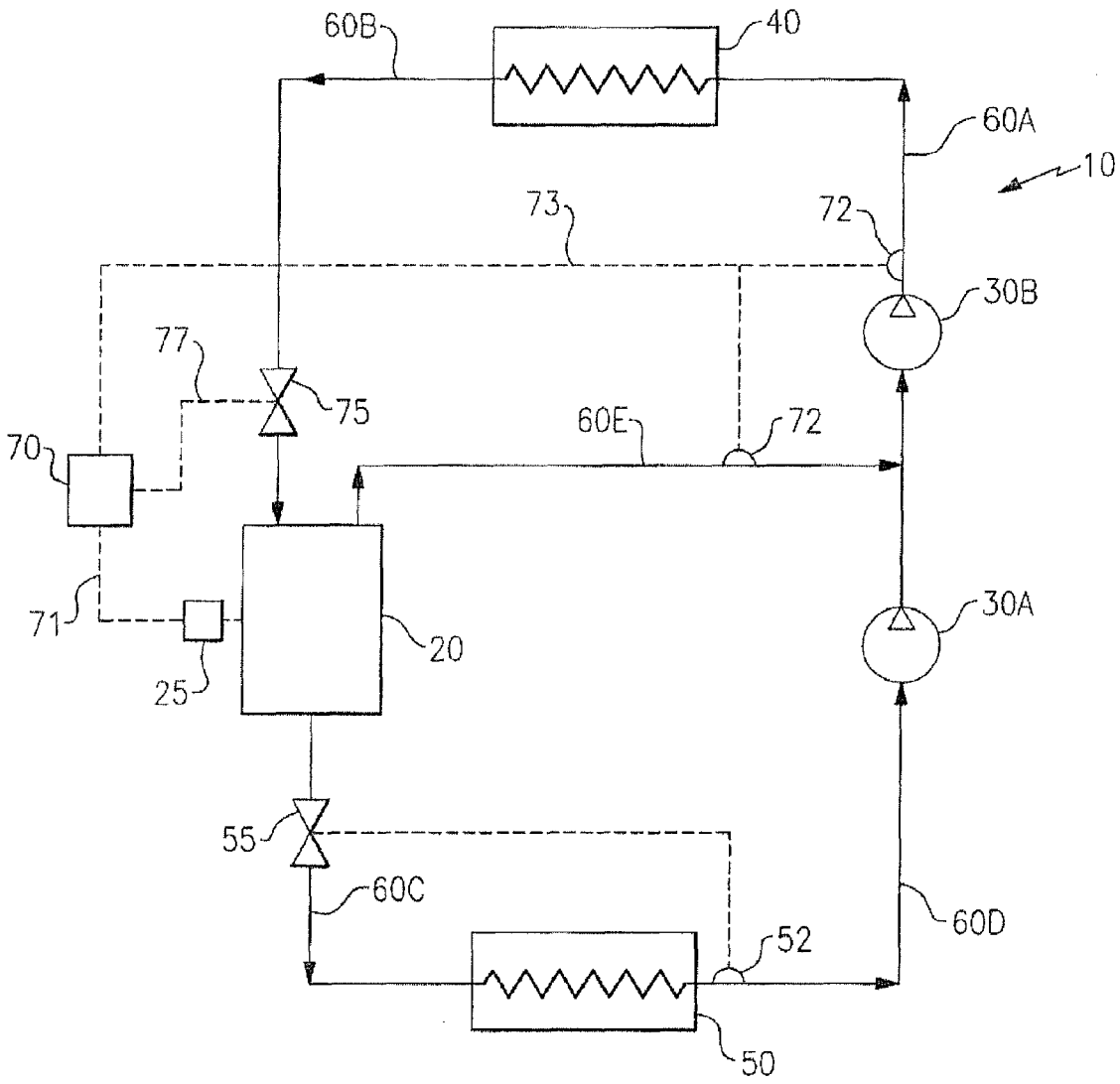
FIG. 2 is a schematic diagram illustrating a second exemplary embodiment of a refrigerant vapor compression system in accord with the invention

Referring now to FIGS. 1 and 2, as in conventional systems, the refrigerant vapor compression system 10 includes a compression device 30, a refrigerant heat rejecting heat exchanger 40, a refrigerant heat absorbing heat exchanger 50, also referred to herein as an evaporator, an evaporator expansion device 55, illustrated as a valve, operatively associated with the evaporator 50, and various refrigerant lines 60A, 60B, 60C, 60D and 60E connecting the aforementioned components in a refrigerant circuit 60. The compression device 30 functions to compress and circulate refrigerant through the refrigerant circuit as will be discussed in further detail hereinafter. The compression device 30 may be a scroll compressor, a screw compressor, a reciprocating compressor, a rotary compressor or any other type of compressor or a plurality of any such compressors. In the embodiment depicted in FIG. 1, the compression device 30 is a single refrigerant compressor, for example a scroll compressor or a screw compressor. In the embodiment depicted in FIG. 2, the compression device 30 is a pair of compressors, for example a pair of reciprocating compressors, connected in series, or a single reciprocating compressor having a first bank and a second bank of cylinders, having a refrigerant line connecting the discharge outlet port of the first compressor 30A in refrigerant flow communication with the suction inlet port of the second compressor 30B or between the first and second banks of cylinders.

Additionally, the refrigerant vapor compression system of the invention includes a flash tank receiver 20 disposed in the refrigerant circuit 60 between the refrigerant heat rejecting heat exchanger 40 and the refrigerant heat absorbing heat exchanger 50. A first expansion device, i.e. the evaporator expansion device 55, is disposed in refrigerant line 60C downstream with respect to the liquid refrigerant flow of the flash tank receiver 20 and upstream with respect to refrigerant flow of the heat exchanger 50. Additionally, a second expansion device 75, illustrated as an expansion valve, is disposed in the refrigerant line 60B downstream with respect to refrigerant flow of the heat exchanger 40 and upstream with respect to refrigerant flow of the flash tank receiver 20. Therefore, the flash tank receiver 20 is disposed in the refrigerant circuit 60 between the first expansion device 55 and the second expansion device 75.

In a refrigerant vapor compression system operating in a subcritical cycle, the refrigerant heat rejecting heat exchanger 40 constitutes a refrigerant condensing heat exchanger through which hot, high pressure refrigerant passes in heat exchange relationship with a cooling medium, most commonly ambient air in air conditioning systems or transport refrigeration systems. In a refrigerant vapor compression system operating in a transcritical cycle, the refrigerant heat rejecting heat exchanger 40 constitutes a gas cooler heat exchanger through which supercritical refrigerant passes in heat exchange relationship with a cooling medium, again most commonly ambient air in air conditioning systems or transport refrigeration systems.

Whether the system 10 is operating in a subcritical or a transcritical cycle, the refrigerant leaving the refrigerant heating rejecting heat exchanger 40 passes through refrigerant line 60B to the flash tank receiver 20. As will be discussed further hereinafter, in doing so, the refrigerant traverses the second expansion device 75 and expands to a lower pressure whereby the refrigerant enters the flash tank receiver 20 as a mixture of liquid refrigerant and vapor refrigerant. The liquid refrigerant settles in the lower portion of the flask tank 20 and the refrigerant vapor collects in the upper portion of the flash tank receiver 20 above the liquid therein.

Liquid refrigerant passing from the flash tank receiver 20 through refrigerant line 60C traverses the first expansion device 55 disposed in the refrigerant line 60C upstream with respect to refrigerant flow of the evaporator 50. As this liquid refrigerant traverses the first expansion device 55, it expands to a lower pressure and temperature before the refrigerant enters the evaporator 50. The evaporator 50 constitutes a refrigerant evaporating heat exchanger through which expanded refrigerant passes in heat exchange relationship with a heating fluid, whereby the refrigerant is vaporized and typically superheated. The heating fluid passed in heat exchange relationship with the refrigerant in the evaporator 50 may be air to be supplied to a climate controlled environment such as a comfort zone associated with an air conditioning system or a perishable cargo storage zone associated with a transport refrigeration unit. The low pressure refrigerant vapor leaving the evaporator 50 returns through refrigerant line 60D to the suction port of the compression device 30 in FIG. 1 or 30A in FIG. 2. The first expansion device 55, which may be a conventional thermostatic expansion valve or electronic expansion valve, receives a signal indicative of the refrigerant temperature or pressure sensed by the sensing device 52, which may be a conventional temperature sensing element, such as a bulb or thermocouple for a TXV or a thermistor and/or pressure transducer for an EXV, meters the refrigerant flow through the refrigerant line 60C to maintain a desired level of superheat or pressure in the refrigerant vapor leaving the evaporator 50, also referred to as the suction temperature or the suction pressure. As in conventional refrigerant vapor compression systems, a suction accumulator (not shown) may be disposed in refrigerant line 60D downstream with respect to refrigerant flow of the evaporator 50 and upstream with respect to refrigerant flow of the compression device 30 (FIG. 1) or 30A (FIG. 2) to remove and store any liquid refrigerant passing through refrigerant line 60D, thereby ensuring that liquid refrigerant does not pass to the suction port of the compression device 30 (FIG. 1) or 30A (FIG. 2).

The refrigerant vapor compression system 10 of the invention further includes a liquid level sensor 25 operating associated with the flash tank receiver 20 and a controller 70. The liquid level sensor 25 senses the level of liquid refrigerant resident within the flash tank receiver 20 and generates a signal indicative of the refrigerant liquid level within the flash tank receiver 20. The controller 70 is adapted to receive the signal indicative of the refrigerant liquid level with the flash tank receiver 20, compare the sensed liquid level to a desired liquid level set point, and selectively control the flow of refrigerant through the second expansion device 75 to adjust the refrigerant liquid level as necessary to maintain a desired liquid level within the flash tank receiver 20 consistent with a desired refrigerant charge circulating within the refrigerant circuit 60. When the amount of liquid refrigerant admitted to the flash tank receiver 20 in the expanded liquid/vapor refrigerant mix flowing into the flash tank receiver 20 through refrigerant line 60B is in equilibrium with the amount of liquid refrigerant passing from the flask tank 20 to the evaporator through refrigerant line 60C, the liquid level within the flash tank receiver 20 will remain constant.

In the refrigerant vapor compression system of the invention, the flask tank receiver 20 serves not only as a charge control tank, but also as a flash tank economizer Vapor refrigerant collecting in the portion of the flash tank receiver 20 above the liquid level therein passes from the flask tank receiver 20 through refrigerant line 60E to return to the compression device 30. If, as depicted in FIG. 1, the compression device 30 is a single refrigerant compressor, for example a scroll compressor or a screw compressor, the refrigerant from the economizer enters the compressor through an injection port opening at an intermediate pressure state into the compression chambers of the compressor. If, as depicted in FIG. 2, the compression device 30 is a pair of compressors, for example a pair of reciprocating compressors, connected in series, or a single reciprocating compressor having a first bank and a second bank of cylinders, the refrigerant from the economizer is injected into the refrigerant line connecting the discharge outlet port of the first compressor 30A in refrigerant flow communication with the suction inlet port of the second compressor 30B or between the first and second banks of cylinders.

In an embodiment, the controller 70 is provided with a preselected desired liquid level set point and programmed to maintain the liquid level in the flash tank receiver 20 within a specified tolerance of that preselected liquid level. In another embodiment, the controller 70 receives from a sensor 72 a signal 71 indicative of the pressure of the refrigerant discharged from the compression device 30, hereinafter referred to as the discharge pressure. The sensor 72 may be mounted on the refrigerant line 60A downstream of the discharge of the compression device 30 or in line 60 B downstream of the heat exchanger 40. In the dual compressor embodiment depicted in FIG. 2, the sensor 72 is mounted to the refrigerant line 60A at the discharge of the second compressor 30B. In yet another embodiment the controller 70 receives signal 71 from sensor 72 which might be either sensing pressure or temperature in refrigerant line 60E.

The sensor 72 may be a pressure sensing device, such as a pressure transducer, capable of directly sensing the refrigerant pressure. Alternatively, the sensor 72 may be a temperature sensing device, such as a thermocouple, a thermister or the like, mounted on the refrigerant line 60A downstream of the discharge of the compression device 30, on refrigerant line 60B downstream of the heat exchanger 40, or on line 60E downstream of flash tank receiver 20. If the sensor 72 is a temperature sensing device, the sensor 72 will transmit a signal 71 to controller 70 directly indicative of the refrigerant discharge temperature or economizer vapor line temperature if sensor 72 is put in line 60E. In such cases, the controller 70 may convert the received temperature signal to a discharge pressure via reference to the characteristic pressure-temperature curve for the particular refrigerant with which the system is charged. In one embodiment where the control parameter is discharge pressure, the controller 70 will compare the sensed discharge pressure to a preprogrammed set point discharge pressure based on the operating condition and selectively control the flow of refrigerant through the second expansion device 75 to adjust the refrigerant liquid level as necessary to maintain a desired liquid level within the flash tank receiver 20 consistent with the refrigerant charge circulating within the refrigerant circuit 60 associated with the discharge pressure desired. In another embodiment where the control parameter is discharge temperature, the controller 70 will compare the sensed temperature to a preprogrammed set point temperature to prevent overheating of the system and selectively control the flow of refrigerant through the second expansion device 75 to adjust the refrigerant liquid level as necessary to maintain a desired liquid level within the flash tank receiver 20 consistent with the refrigerant charge circulating within the refrigerant circuit 60 associated with the temperatures desired. In yet another embodiment where the control parameter is economizer pressure, the controller 70 will try to maintain the flash tank receiver 20, inlet pressure at slightly higher pressure and selectively control the flow of refrigerant through the second expansion device 75 to adjust the refrigerant liquid level as necessary to maintain a desired liquid level within the flash tank receiver 20 consistent with the refrigerant charge circulating within the refrigerant circuit 60 associated with the economizer pressure. In case the sensed parameter is economizer temperature then the controller will convert it to saturation pressure corresponding to the temperature sensed and apply the above mentioned controls. In any or all of these embodiments the controller 70 may receive signals from other sensors mounted within the system (not shown) including but not limited to the temperature of the refrigerated space or the temperature of the ambient environment or other parameters which are used by the controller 70 in addition to assist in defining the given operating condition and in determining the desired refrigerant charge circulating within the refrigerant circuit. A combination of any or all of these embodiments may be incorporated into a single system where the active embodiment, that is the embodiment which is operative at any given time to control operation of expansion valve 75, is selected by controller 70 to provide optimum or otherwise desirable operating characteristics for the operating conditions existing in the system at that given time.

More specifically, in case the sensed parameter is discharge pressure then, if the discharge pressure is below the set point discharge pressure, the controller 70 will adjust the second expansion valve 75 to restrict refrigerant flow into the flash tank receiver 20 until the liquid within the flash tank receiver 20 has risen to a level at which the charge circulating within the refrigerant circuit 60 has decreased sufficiently to increase the sensed discharge pressure to the set point discharge pressure. Conversely, if the sensed discharge pressure is above the set point discharge pressure, the controller 70 will adjust the second expansion valve 75 to increase refrigerant flow into the flash tank receiver 20 until the liquid within the flash tank receiver 20 has dropped to a level at which the charge circulating within the refrigerant circuit 60 has increased sufficiently to decrease the sensed discharge pressure to the set point discharge pressure. Once the sensed discharge pressure has equalized to the set point discharge pressure, the controller 70 will continue to adjust the second expansion valve 75 to control refrigerant flow therethrough to maintain the liquid level within the flash tank receiver 20 at that liquid level.

Figure 3:
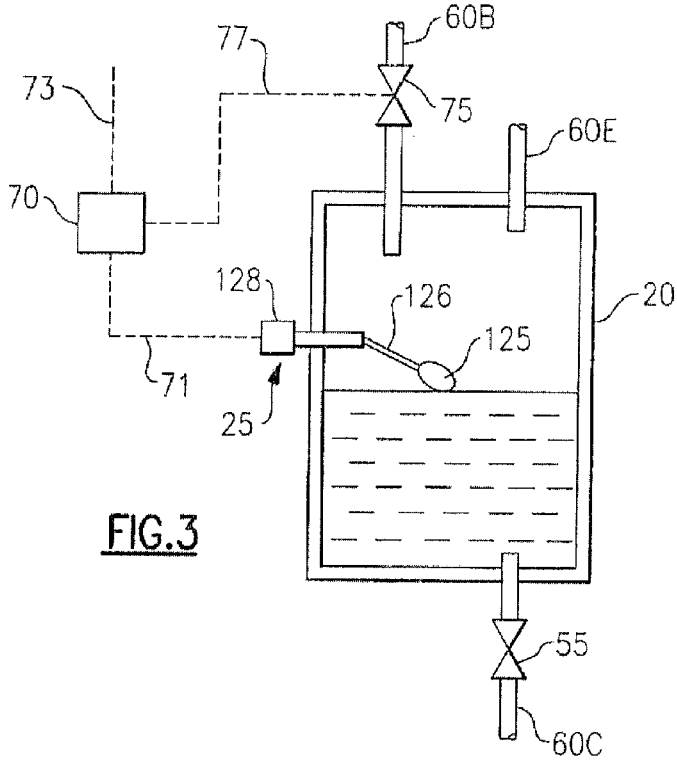
FIG. 3 is a schematic diagram illustrating an exemplary embodiment of the flash tank receiver of the refrigerant vapor compression system of the invention.

Referring now to FIG. 3, there is depicted an exemplary embodiment of a flash tank receiver liquid level control method for use in connection with the refrigerant vapor compression system of the invention. The liquid level sensor 25 operatively associated with the flash tank receiver 20 is a conventional horizontal float type liquid level sensor having a float 125 disposed at the distal end of an arm 126 pivotally supported on a base 128. A magnet (not shown) is disposed at the opposite end of the arm 126 which, as a result of the pivotal movement of the float 125 as it rises and falls in response to changes in the refrigerant liquid level within the flash tank receiver 20, moves relative to a magnetic reed switch (not shown) to generate the signal 71 which is transmitted to the controller 70. Refrigerant line 60B through which refrigerant is delivered into the flash tank receiver 20 opens into an upper region of the flash tank receiver 20 above the normal liquid level therein and refrigerant line 60C through which liquid refrigerant is removed from the flash tank receiver 20 opens into a lower region of the flash tank receiver 20 below the normal liquid level therein. Refrigerant line 60E through which refrigerant vapor passes out of the flash tank receiver 20 also opens into the upper region of the flash tank receiver 20 well above the normal liquid level therein. Based on the sensed liquid level indicated by the signal 71 versus the desired liquid level consistent with the proper refrigerant charge for circulation in the refrigerant circuit 60 at system operating conditions, the controller 70 sends a control signal 77 to the second expansion valve 75 to adjust the positioning of the valve 75 to reduce or increase the flow of refrigerant into the flash tank receiver 20 thereby regulating the liquid level within the flash tank receiver 20.

Figure 4:
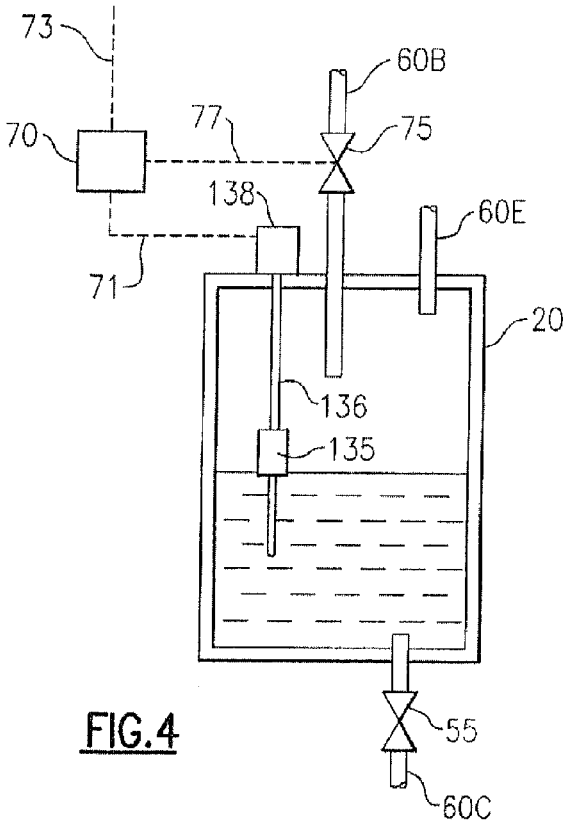
FIG. 4 is a schematic diagram illustrating another exemplary embodiment of the flash tank receiver of the refrigerant vapor compression system of the invention.

Referring now to FIG. 4, there is depicted another exemplary embodiment of a flash tank receiver liquid level control method for use in connection with the refrigerant vapor compression system of the invention. The liquid level sensor 25 operatively associated with the flash tank receiver 20 is a conventional vertical float type liquid level sensor having a float 135 mounted on a vertical guide member 136 suspended from a base 138 mounted to the roof of the flash tank receiver 20. In operation, the float 135 rises and falls in response to changes in the refrigerant liquid level within the flash tank receiver 20. The float 135 contains a magnet (not shown) which translates relative to an associated magnet reed switch (not shown) carrier on or in the guide member 136 to generate the signal 71 which is transmitted to the controller 70. Refrigerant line 60B through which refrigerant is delivered into the flash tank receiver 20 opens into an upper region of the flash tank receiver 20 above the normal liquid level therein and refrigerant line 60C through which liquid refrigerant is removed from the flash tank receiver 20 opens into a lower region of the flash tank receiver 20 below the normal liquid level therein. Refrigerant line 60E through which refrigerant vapor passes out of the flash tank receiver 20 also opens into the upper region of the flash tank receiver 20 well above the normal liquid level therein. Again, based on the sensed liquid level indicated by the signal 71 versus the desired liquid level consistent with the proper refrigerant charge for circulation in the refrigerant circuit 60 at system operating conditions, the controller 70 sends a control signal 77 to the second expansion valve 75 to adjust the positioning of the valve 75 to reduce or increase the flow of refrigerant into the flash tank receiver 20 thereby regulating the liquid level within the flash tank receiver 20.

Figure 5:
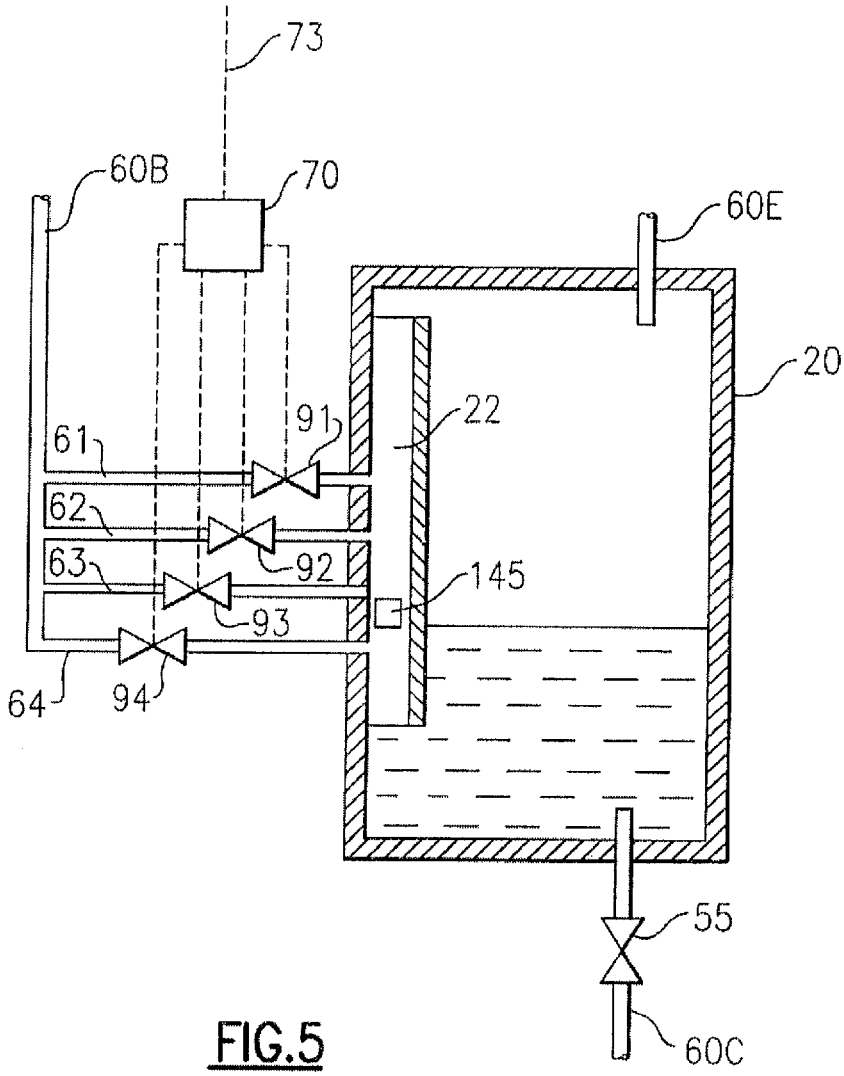
FIG. 5 is a schematic diagram illustrating further exemplary embodiment of the flash tank receiver of the refrigerant vapor compression system of the invention.

Referring now to FIG. 5, there is depicted another exemplary embodiment of a flash tank receiver liquid level control method for use in connection with the refrigerant vapor compression system of the invention. In this embodiment, a float 145, which is disposed within a vertically elongated channel 22 provided within the flash tank receiver 20, rises and falls within the channel 22 in response to the liquid level within the flash tank receiver 20. The channel 22 has an open bottom opening to the lower portion of the reservoir of the flash tank receiver 20 and an open top opening to the upper portion of the reservoir of the flash tank receiver 20 whereby the liquid level within the channel and the liquid level with the remainder of the flash tank receiver reservoir will always be the same. Additionally a plurality of expansion valves 91, 92, 93 and 94 are provided in respective branches 61, 62, 63 and 64 off the refrigerant line 60B, each of which opens directly into the reservoir of the flash tank receiver 20, but at different levels vertically. The controller 70 selectively opens one of the plurality of valves 91, 92, 93 and 94 to direct refrigerant flow from the gas cooler into the flash tank receiver 20 through only that one selected valve at any given time. The float 145 interacts with each of the branches 61, 62, 63, or 64 at the location they enter the flash tank receiver 20 to regulate the liquid level in the flash tank receiver to a level commensurate with which of the branches 61, 62, 63, or 64 are open at any given time. As refrigerant from the gas cooler 40 passes through the selected one of the plurality of expansion valves 91, 92, 93, 94, the refrigerant expands to a lower pressure and temperature to enter the flash tank receiver 20 as a refrigerant liquid/vapor mixture. As in the other embodiments, the refrigerant line 60C through which liquid refrigerant is removed from the flash tank receiver 20 opens into a lower region of the flash tank receiver 20 below the normal liquid level therein and refrigerant line 60E through which refrigerant vapor passes out of the flash tank receiver 20 opens into the upper region of the flash tank receiver 20 well above the normal liquid level therein.

The liquid refrigerant will collect in the lower portion of the reservoir defined by the flash tank receiver 20 and the vapor refrigerant will collect in the upper portion of the reservoir. As the liquid level within the reservoir changes, the float 145 will rise and fall accordingly within the channel 22, thus moving relative to the inlets of the respective refrigerant branch lines 61, 62, 63 and 64.

Those skilled in the art will recognize that many variations may be made to the exemplary embodiments described herein. For example, the liquid level sensor 25 is not limited to a float-type liquid level sensor. Rather, skilled practitioners will recognize that a float-less type liquid level sensor, such as a conventional pressure transmitter liquid level sensor or ultrasonic transmitter liquid level sensor may be employed in the system of the invention. Additionally, the refrigerant vapor compression system of the invention may be operated in either a subcritical cycle or a transcritical cycle.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A refrigerant vapor compression system comprising:

a refrigerant circuit including a refrigerant compression device, a refrigerant cooling heat exchanger for passing refrigerant received from said compression device at a high pressure in heat exchange relationship with a cooling medium, a refrigerant heating heat exchanger for passing refrigerant at a low pressure refrigerant in heat exchange relationship with a heating medium, and a main expansion device disposed in the refrigerant circuit downstream of said refrigerant cooling heat exchanger and upstream of said refrigerant heating heat exchanger;

a flash tank receiver disposed in the refrigerant circuit downstream of said refrigerant cooling heat exchanger and upstream of said main expansion device;

a secondary expansion device disposed in the refrigerant circuit downstream of said refrigerant cooling heat exchanger and upstream with of said flash tank receiver;

said secondary expansion device operative to expand the high pressure refrigerant flowing therethrough to a liquid/vapor refrigerant mix at a lower pressure intermediate the high pressure and the low pressure and to control the flow of refrigerant into said flash tank receiver; and a refrigerant charge control apparatus including at least one sensor operatively associated with said refrigerant compression device for sensing an operating characteristic of the refrigerant circulating through the refrigerant compression device, and a controller operatively associated with said secondary expansion device and said at least one sensor, said controller operative in response to at least the system operating characteristic sensed by said at least one sensor to selectively adjust said secondary expansion device to increase or decrease the flow of refrigerant passing therethrough to maintain a circulating refrigerant charge consistent with a desired operating characteristic of the refrigerant, said sensed operating characteristic being at least one of (a) the vapor refrigerant passing through a refrigerant line from the flash tank receiver to an intermediate pressure stage of the compression device, and (b) the refrigerant discharged from the compression device.

2. The refrigerant vapor compression system as recited in claim 1 wherein the sensed operating characteristic is refrigerant temperature.

3. The refrigerant vapor compression system as recited in claim 1 wherein the sensed operating characteristic is refrigerant pressure.

4. The refrigerant vapor compression system as recited in claim 1, wherein the refrigerant line from the flash tank receiver to an intermediate pressure stage of the compression device comprises an economizer refrigerant line establishing a refrigerant flow path from an upper region of said flash tank receiver and an intermediate pressure region of said compression device for passing a flow of vapor refrigerant from said flash tank receiver into said compression device.

5. The refrigerant vapor compression system as recited in claim 1 wherein said compression device comprises a single compressor having at least two compression stages.

6. The refrigerant vapor compression system as recited in claim 1 wherein said compression device comprises at least two compressors disposed in the refrigerant circuit in a series relationship with respect to refrigerant flow.

7. The refrigerant vapor compression system as recited in claim 1 wherein said system operates in a subcritical cycle.

8. The refrigerant vapor compression system as recited in claim 1 wherein said system operates in a transcritical cycle.

9. The refrigerant vapor compression system as recited in claim 1 wherein the refrigerant is carbon dioxide.

10. The refrigerant vapor compression system as recited in claim 1 wherein said controller is operative to determine a desired liquid refrigerant level to be stored within said flash tank receiver in response to at least the sensed refrigerant operating characteristic sensed by said at least one sensor and an ambient temperature measurement.

11. The refrigerant vapor compression system as recited in claim 1 wherein said controller is operative to determine a desired liquid refrigerant level to be stored within said flash tank receiver in response to at least the sensed refrigerant operating characteristic sensed by said at least one sensor and an air temperature of a conditioned environment operatively associated with said refrigerant vapor compression system.

12. A transport refrigeration system for cooling air supplied to a temperature controlled cargo space, said transport refrigeration system comprising:

a refrigerant circuit including a refrigerant compression device, a refrigerant cooling heat exchanger, a refrigerant heating heat exchanger for passing low pressure refrigerant in heat exchange relationship with air to be supplied to the cargo space, and a main expansion device disposed in the refrigerant circuit downstream of said refrigerant cooling heat exchanger and upstream of said refrigerant heating heat exchanger;

a flash tank receiver disposed in the refrigerant circuit downstream of said refrigerant cooling heat exchanger and upstream of said main expansion device;

a secondary expansion device disposed in the refrigerant circuit downstream of said refrigerant cooling heat exchanger and upstream with of said flash tank receiver;

said secondary expansion device operative to expand the high pressure refrigerant flowing therethrough to a liquid/vapor refrigerant mix at a lower pressure intermediate the high pressure and the low pressure and to control the flow of refrigerant into said flash tank receiver;

a refrigerant charge control apparatus including at least one sensor operatively associated with said refrigerant compression device for sensing an operating characteristic of the refrigerant circulating through the refrigerant compression device, and a controller operatively associated with said secondary expansion device and said at least one sensor, said controller operative in response to at least the system operating characteristic sensed by said at least one sensor to selectively adjust said secondary expansion device to increase or decrease the flow of refrigerant passing therethrough to maintain a circulating refrigerant charge consistent with a desired operating characteristic of the refrigerant, said sensed operating characteristic being at least one of (a) the vapor refrigerant passing through a refrigerant line from the flash tank receiver to an intermediate pressure stage of the compression device, and (b) the refrigerant discharged from the compression device.

13. The transport refrigeration system as recited in claim 12, wherein the refrigerant line from the flash tank receiver to an intermediate pressure stage of the compression device comprises an economizer refrigerant line establishing a refrigerant flow path from an upper region of said flash tank receiver and an intermediate pressure region of said compression device for passing a flow of vapor refrigerant from said flash tank receiver into said compression device.

14. The transport refrigeration system as recited in claim 12 wherein the sensed operating characteristic is refrigerant temperature.

15. The transport refrigeration system as recited in claim 12 wherein the sensed operating characteristic is refrigerant pressure.

* * * * *